United States Patent [19]

Bastian et al.

[11] Patent Number: 4,756,485

[45] Date of Patent: Jul. 12, 1988

[54] DISPENSER FOR MULTIPLE ROLLS OF SHEET MATERIAL

[75] Inventors: Lehyman J. Bastian, Media; Alan D. Frazier, West Chester, both of Pa.; Dean H. Heili, Manitowoc, Wis.; Richard D. Kley, West Chester, Pa.

[73] Assignee: Scott Paper Company, Philadelphia, Pa.

[21] Appl. No.: 24,650

[22] Filed: Mar. 11, 1987

[51] Int. Cl.[4] ..... B65H 19/00

[52] U.S. Cl. ..... 242/55.3; 242/55.53; 312/39

[58] Field of Search ..... 312/38, 39; 242/55.2, 242/55.3, 55.53, 58, 58.4, 67.3 R, 68.4, 57; 226/127; 206/389, 398

[56] References Cited

U.S. PATENT DOCUMENTS

| | | | |
|---|---|---|---|
| 2,601,956 | 7/1952 | Birr | 242/55.53 |
| 3,007,650 | 11/1961 | Burton | 242/55.3 |
| 3,288,387 | 11/1966 | Craven | 242/55.53 |
| 3,628,743 | 12/1971 | Bastian et al. | 242/55.3 |
| 3,797,769 | 3/1974 | Tucker | 242/55.53 |
| 3,948,454 | 4/1976 | Bastian | 242/55.3 |
| 4,192,442 | 3/1980 | Bastian et al. | 226/127 |

FOREIGN PATENT DOCUMENTS

| | | | |
|---|---|---|---|
| 22245 | 2/1983 | Japan | 242/55.53 |

*Primary Examiner*—David Werner

*Attorney, Agent, or Firm*—Joseph H. Yamaoka; John W. Kane, Jr.

[57] ABSTRACT

A multiple roll towel dispenser. The dispenser cabinet has a pair of feed rollers forming a feed roll nip, means for driving one of the feed rollers to dispense web from the cabinet, means in the cabinet for supporting a first roll of web material with its web extended between the feed roll nip, and means for supporting a second roll of web material with its web extended adjacent to the feed roll nip. The dispenser also includes means, contacting the edge of the first roll, having a first position for sensing the diameter of the first roll; means, connected to the sensing means, for biasing the sensing means against the edge of the first roll; biased transfer means for introducing the extended web of the second roll into the feed roll nip; and stop means, connected to the sensing means, the stop means being located to resist motion of the transfer means at a ready position when the edge of the first roll resists movement of the sensing means. When the edge of the first roll no longer resists movement of the sensing means, the sensing means and connected stop means moves to a second position which allows the biased transfer means to move to a transfer position where the extended web of the second roll is introduced into the feed roll nip.

10 Claims, 5 Drawing Sheets

Fig. 4
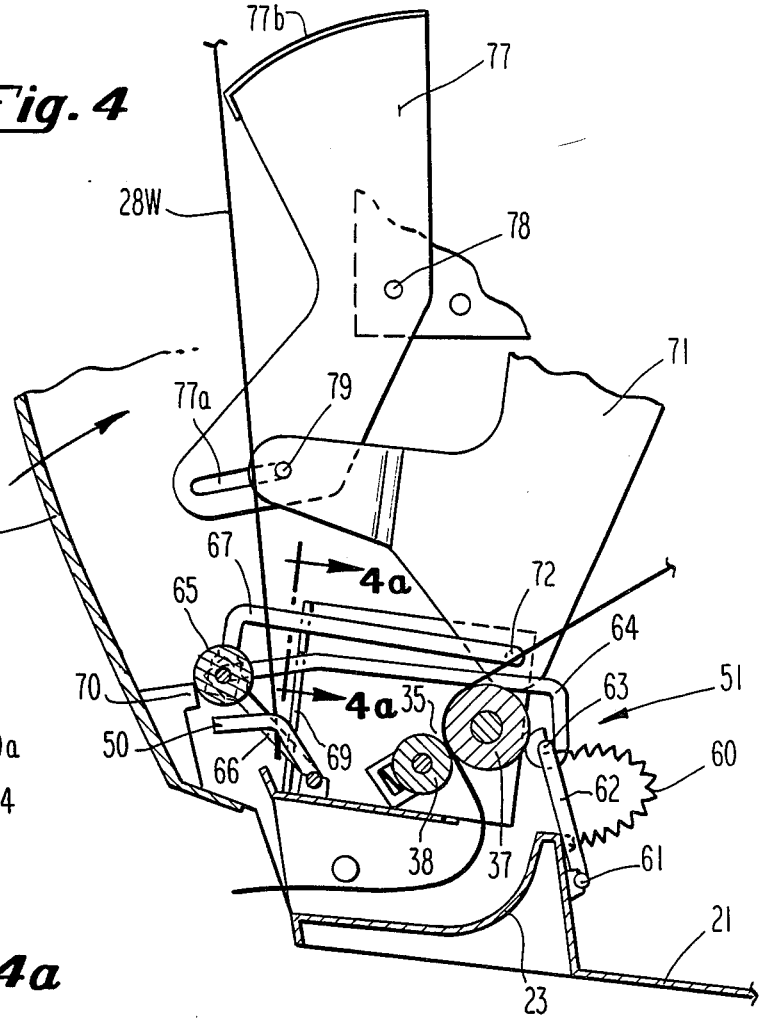
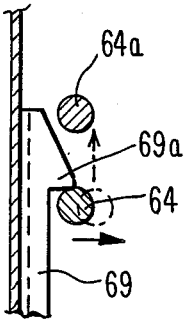
Fig. 4a
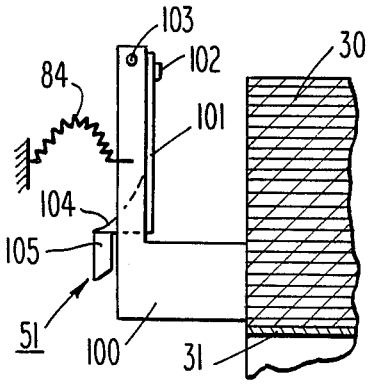
Fig. 7a
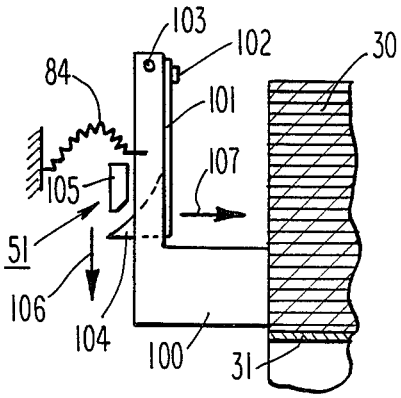
Fig. 7b

DISPENSER FOR MULTIPLE ROLLS OF SHEET MATERIAL

TECHNICAL FIELD

This invention relates to dispensers of sheet material, such as paper toweling wound in a roll, and more particularly to a dispenser for multiple rolls in which dispensing is automatically transferred to a second roll when the first roll has been depleted and to a dispenser having stabilized means for supporting the roll in the cabinet.

BACKGROUND ART

When two rolls of paper towels are dispensed from a cabinet, the cabinet usually includes means for sensing that the first roll is exhausted and then automatically dispenses from a second roll. One such dispenser is disclosed in U.S. Pat. No. 3,007,650-Burton wherein paper from a roll A is dispensed through a nip formed by feed rollers 15, 16 and paper from a second roll B is dispensed through a nip formed by feed rollers 19, 20. Feed rollers 16 and 20 are grooved and spring loaded sensing fingers 47 ride on the paper over the grooves. When a roll is depleted, and the end of the web of the depleted roll has passed over its respective feed roller 16, 20, the spring loaded finger 47 will enter the groove and an associated arm 48 will initiate dispensing from the other roll. Burton also discloses that an element within the dispenser can be caused to move when the door is opened.

U.S. Pat. No. 3,288,387-Craven eliminates one pair of feed rollers. In Craven the extended web from the first roll is fed through a nip formed by a pair of driven feed rollers and the web from a second roll of paper is extended and held by gripping means adjacent to the nip of the feed rollers. A roller riding on the first roll acts as a sensing member. The core of the first roll has a cavity and upon depletion of the first roll, the sensing roller falls into the cavity which causes the gripping means to introduce the web of the second roll into the nip of the feed rollers thereby allowing paper from the second roll to be dispensed through the cabinet.

Another approach for sensing when a first roll is exhausted and introducing the web of a second roll into the nip formed by a pair of feed rollers is described in U.S. Pat. No. 3,628,743-Bastian, assigned to the assignee of this invention. Bastian uses a following roller that contacts the surface of the first roll to sense the diameter of that roll. Transfer means for introducing the web of the second roll into the nip of the feed rollers is connected to and travels with the following roller. When the first roll is exhausted, the following roller and connected transfer means will have pressed the extended web of the second roll into the nip formed by the feed rollers.

U.S. Pat No. 3,948,454-Bastian, assigned to the assignee of this invention, discloses a two-roll tissue dispenser wherein a pivoted lever 20 has at one end thereof a knob 12 that senses when a first roll of tissue is exhausted and enables a second roll of tissue to drop down into a dispensing zone of the dispenser.

When a dispenser is capable of dispensing both from a first roll and then from a second roll, it would be desirable to have an indication of when paper is being dispensed from the second roll so that the person servicing the dispenser could readily observe that a new roll of paper can be placed into the dispenser. U.S. Pat. No. 2,601,956-Birr discloses a roll usage indicator for a single roll dispensing cabinet. In the Birr dispensing cabinet, a pivoted arm 30 maintains contact with a periphery of the roll. An indicator 34 attached to the arm 30 is visible through a slot in the sidewall of the dispenser. The position of the indicator 34 in the slot indicates the amount of toweling that remains in the cabinet.

One method of supporting rolls of towels in a dispenser is to mount the roll on a pair of hubs when extend into the core of the roll. One of the hubs is usually mounted on an arm that is moveable or spreadable in the axial direction of the roll so that an attendant can readily place a new roll in the cabinet. One problem with using a spreadable support arm is that if a cabinet is subjected to a blow on a sidewall, the arm may spread sufficiently so that the hub comes out of the core and the roll falls off the support into the cabinet. U.S. Pat No. 3,797,769-Tucker, as depicted in FIG. 7, overcomes this problem by employing a stop 90 and a pin 92 to limit the lateral travel of the roll support member.

It is an object of this invention to provide in a multiple roll dispensing cabinet means for sensing that a first roll is depleted and means for automatically transferring to dispensing from a second roll.

It is another object of this invention to provide a visual indication that the dispenser is dispensing from a second roll.

And yet another object of this invention is to provide means for stabilizing the support of the roll within the dispenser that is activated when the door of the dispenser is closed and inactivated when the door of the dispenser is open.

DISCLOSURE OF THE INVENTION

In accordance with this invention, there is provided a dispensing cabinet having a pair of feed rollers forming a feed roll nip, means for driving one of the feed rollers to dispense web from the cabinet, means for supporting a first roll of web material with its web extended between the feed roll nip, and means for supporting a second roll of web material with its web extended adjacent to the feed roll nip. The dispensing cabinet also has means, contacting the edge of the first roll, having a first position for sensing the diameter of the first roll; means, connected to the sensing means, for biasing the sensing means against the edge of the first roll; biased transfer means for introducing the extended web of the second roll into the feed roll nip; and stop means, connected to the sensing means. The stop means is located to resist motion of the transfer means at a ready position when the edge of the first roll resists movement of the sensing means, but when the edge of the first roll no longer resists movement of the sensing means, the sensing means and connected stop means moves to a second position which allows the biased transfer means to move to a transfer position where the extended web of the second roll is introduced into the feed roll nip.

In another aspect of this invention, the dispensing cabinet also includes means for indicating that the web of the second roll has been introduced into the feed roll nip, the indicating means being responsive to the position of the sensing means and having a first position when the edge of the first roll resists motion of the sensing means and a second position visible from outside the dispenser when the edge of the first roll no longer resists motion of the sensing means.

In yet another aspect of this invention, after the biased transfer means introduces the extended web of the second roll into the feed roll nip, a portion of the transfer means prevents the sensing means from returning to the first sensing position unless the transfer means is moved to a RELOAD position.

In another aspect of this invention, the dispensing cabinet has a door and the means for supporting one roll in the cabinet has at least one arm spreadable in the axial direction of the roll to facilitate mounting a new roll in the cabinet. Means are provided in the cabinet responsive to the position of the door for stabilizing the spreadable arm, the arm stabilizing means having a first position that allows spreading of the one arm when the door is open and a second position that limits spreading of the one arm when the door is closed.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

FIG. 4 is a partial sectional side elevation view of the dispensing cabinet showing the transfer means in the RELOAD position just as it is being moved to the READY position by the closing of the door;

FIG. 4*a* is a partial sectional view taken along the line 4*a*—4*a* of FIG. 4;

FIGS. 7*a* and 7*b* are partial schematic representations of an alternate embodiment of the sensing means, stop means and transfer means of this invention.

BEST MODE FOR CARRYING OUT THE INVENTION

Figure 1:
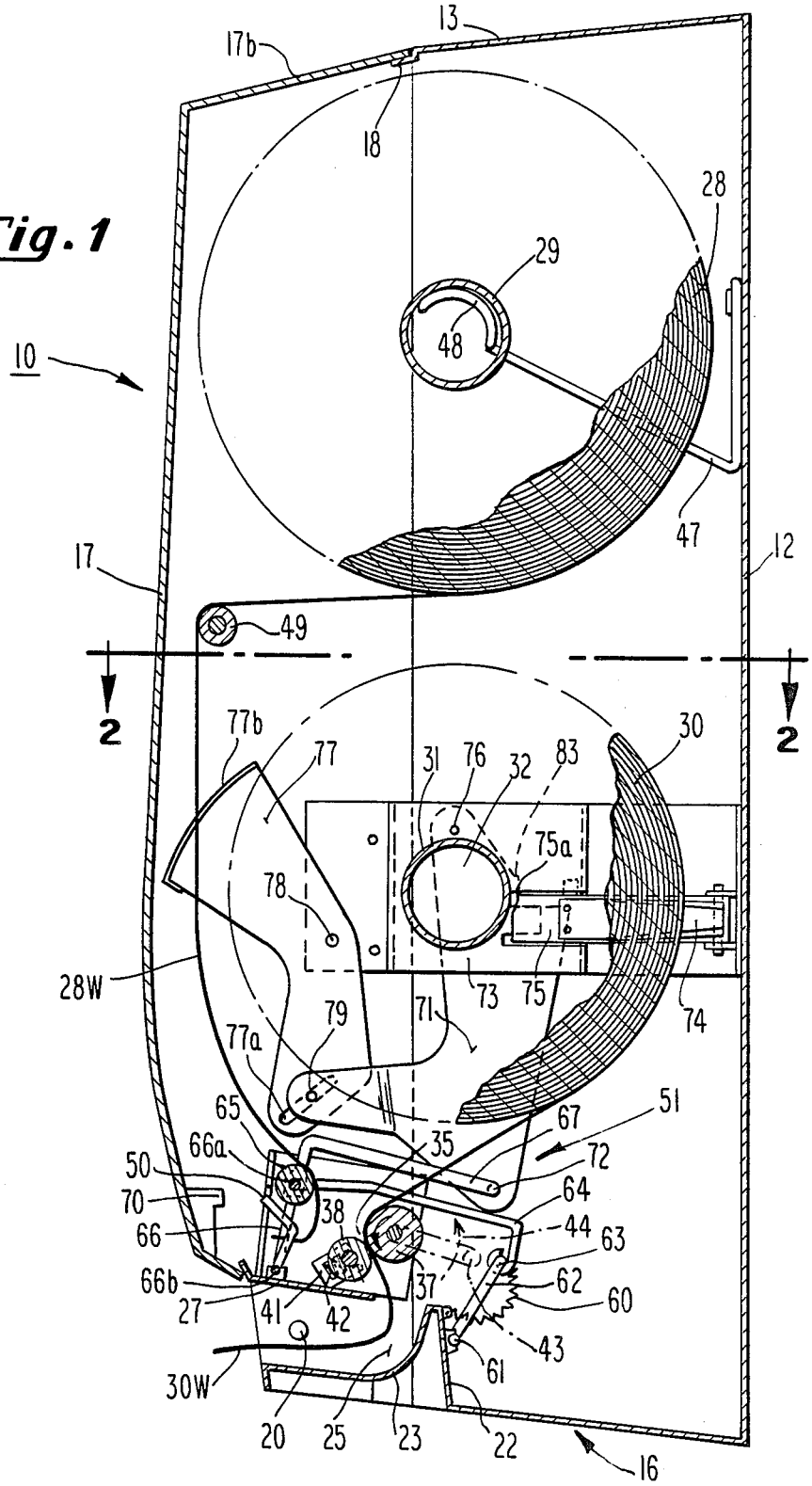
FIG. 1 is a sectional side elevation view of the dispensing cabinet of the invention, showing the transfer means in a READY position after the cabinet has been serviced by an attendant.
Figure 2:
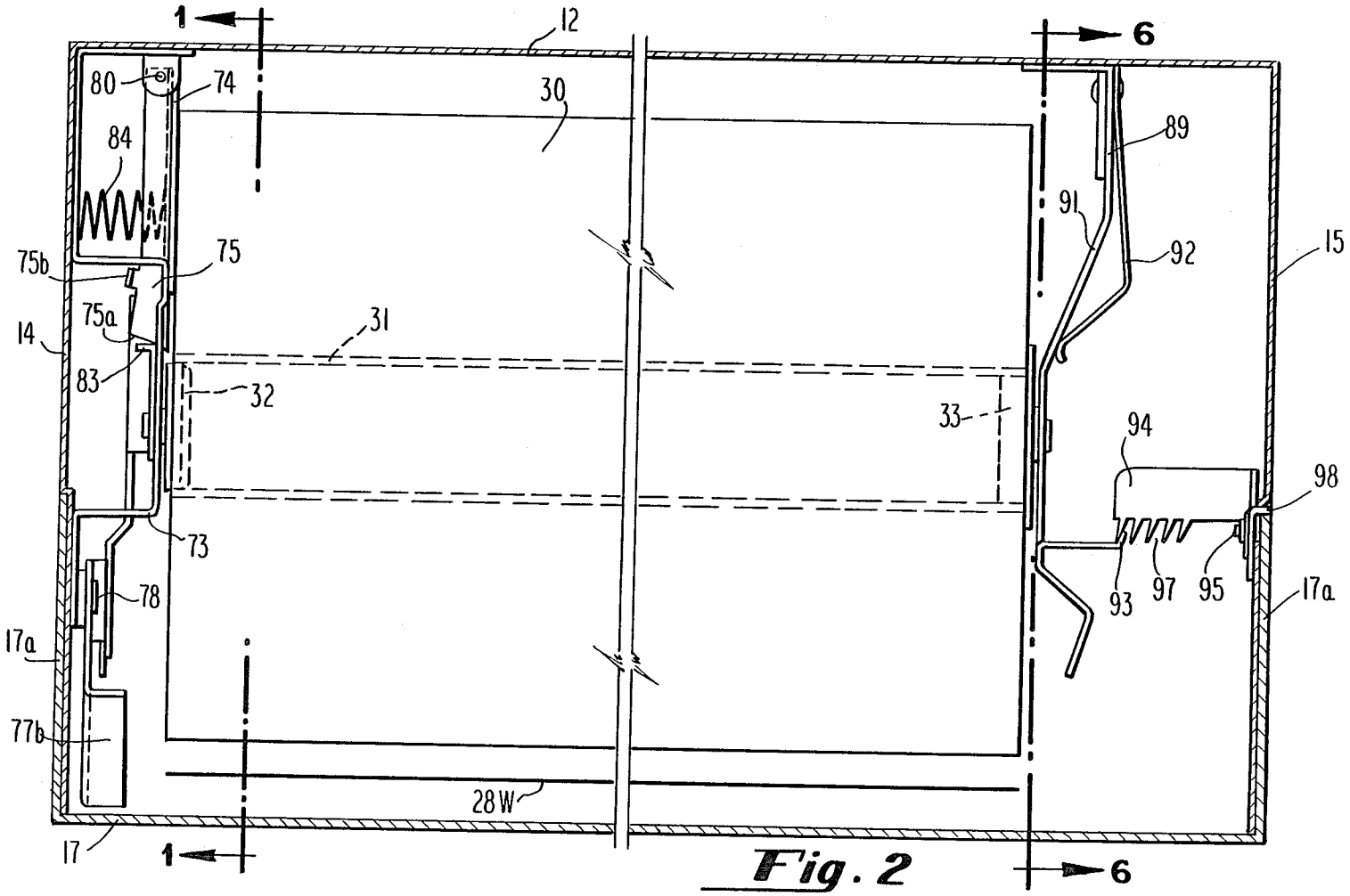
FIG. 2 is a sectional view taken along the line 2—2 of FIG. 1.

For the sake of convenience, an element depicted in more than one Figure will retain the same element number in each Figure. Referring now to FIGS. 1 and 2, the dispensing cabinet 10 of the invention includes a housing having a rear wall 12, a top wall 13, a left sidewall 14, a right sidewall 15, a bottom 16 and a front door 17 which provides convenient access to the cabinet 10 so that fresh rolls 28, 30 of sheet material can be inserted therein. The door 17 has a top wall 17*b* that mates with lip 18 at the edge of top wall 13 of the housing. The door 17 also has two sidewalls 17*a* and is pivotably attached by pins 20 through its sidewalls 17*a* to the respective sidewalls 14, 15 of the housing. This allows the door 17 to be pivotably lowered as partially shown in FIG. 4 so as to expose the dispensing mechanism and rolls of sheet material located inside the dispensing cabinet 10.

The bottom wall 16 of the housing includes a generally horizontal rear portion 21 extending from the rear wall 12 to a nearly vertical section 22 which connects to a downwardly extending arcuate section 23 and terminates in a downwardly extending lip 24. The upper surface of the arcuate section 23 is smooth and forms one wall of an arcuate dispensing passageway 25 terminating in a dispensing opening 26. The other wall of arcuate passageway 25 is formed by a plate 27 extending transversely between the sidewalls 14, 15 and rearwardly from the lower edge of door 17 to a point spaced from the arcuate section 23 of the bottom wall 16.

Two rolls 28 and 30 of wound sheet material are disposed in spaced-apart and generally parallel relationship in the dispensing cabinet 10. The lower or first roll 30 of sheet material, which may be either a completely fresh or a partially used roll, is wound on a core 31. As best shown in FIG. 2, the first roll 30 is supported within the dispenser 10 by means of freewheeling hubs 32 and 33 which extend into the core 31 of the roll 30. The sheet material 30W from the first roll 30 passes through a feed roll nip 35 formed by feed rollers 37 and 38 and passes through dispensing opening 26 at the bottom of the dispensing cabinet 10.

Feed rollers 37, 38 are two parallel, rotatably mounted rollers arranged to form a pressure nip 35 through which the sheet material is drawn prior to being dispensed from the cabinet. In one preferred embodiment, feed roller 37 is mounted in the dispenser 10 with its axis in a fixed position and feed roller 38 is mounted in the dispenser 10 with its axis moveable toward and away from the axis of feed roller 37. The ends of the feed roller 38 are of reduced diameter and are carried in brackets 41 which house coil springs 42 which exert a force on the ends 40 of feed roller 38 so as to press feed roller 38 against feed roller 37. The sheet material 30W issuing from the feed roll nip 35 is fed into dispensing passageway 25 and issues from dispensing opening 26 located in the lower front of the dispensing cabinet 10. Connected to feed roller 37 is drive means 43 which as illustrated in FIG. 1 is a crank. In one preferred embodiment feed rollers 37 and 38 are driven by means of a lever as disclosed in U.S. Pat No. 4,192,442-Bastian, et al., assigned to the assignee of the present invention.

The upper or second roll 28 of sheet material is wound on a core 29 and serves as a backup roll. Roll 28 is rotatably supported on spaced-apart wire brackets 47 which have inwardly depending portions 48 which project inwardly into the core 29 of roll 28. The wire brackets 47 are fixed to the rear wall 12 of the dispensing cabinet 10. The leading end 28W of the sheet material running from the second roll 28 passes over a spacer bar 49, continues down past first roll 30 then passes between a transfer roller 65 and feed rollers 37, 38, the end of the web 28W being impaled on a prong 50. The prong 50 maintains the end 28W of second roll 28 in a position where it can be fed into the nip 35 of feed rollers 37, 38 as hereinafter described.

Transfer means 51 which introduces web 28W into the nip 35 of feed rollers 37, 38 consists of a rear transfer link 62, middle transfer link 64, front transfer link 66, cross over link 67 and actuator arm 71. Rear transfer link 62 has one end 61 pivotally connected to the vertical section 22 of the bottom wall 16. The other end of the rear transfer link 61 is pivotally connected at 63 to one end of middle transfer link 64. The other end of middle transfer link 64 is pivotally connected to the front transfer link 66. Front transfer link 66 includes an upper bar 66*a* which extends parallel to drive rollers 37, 38 and carries on it the transfer roller 65 that presses the web 28W into the nip 35 of drive rollers 37, 38. Also forming a part of front transfer link 66 is bar 66*b*, which also extends parallel to feed rollers 37, 38 but is pivotally connected to front plate 27 of the bottom 16 of the dispenser 10. The prong 50 for securing the end 28W of the backup roll is connected to bar 66*b* midway across the cabinet. The cross over link 67 has one end pivotally connected to the point at which the front transfer link 66 and the middle transfer link 64 are pivotally connected. The other end of the cross over link 67 is pivotally connected to the actuator arm 71 at pivot point 72. Actuator arm 71 is pivotally connected at pivot point 76 to a transfer housing bracket 73 mounted within the cabinet 10. A spring 60 having one end connected to the vertical portion 22 of bottom wall 16 and having its other end connected to the pivot connection 63 between rear transfer link 62 and middle transfer link 64 biases all of the elements of the transfer means 51 so that they tend to move toward the rear of the dispenser cabinet 10.

A flag 77 is pivotally connected to the transfer housing bracket 73 at pivot point 78. The bottom of flag 77 has a slot 77*a* that cooperates with pin 79 to transfer arm 71 to provide a sliding pivot connection between actuator arm 71 and flag 77.

Figure 3:
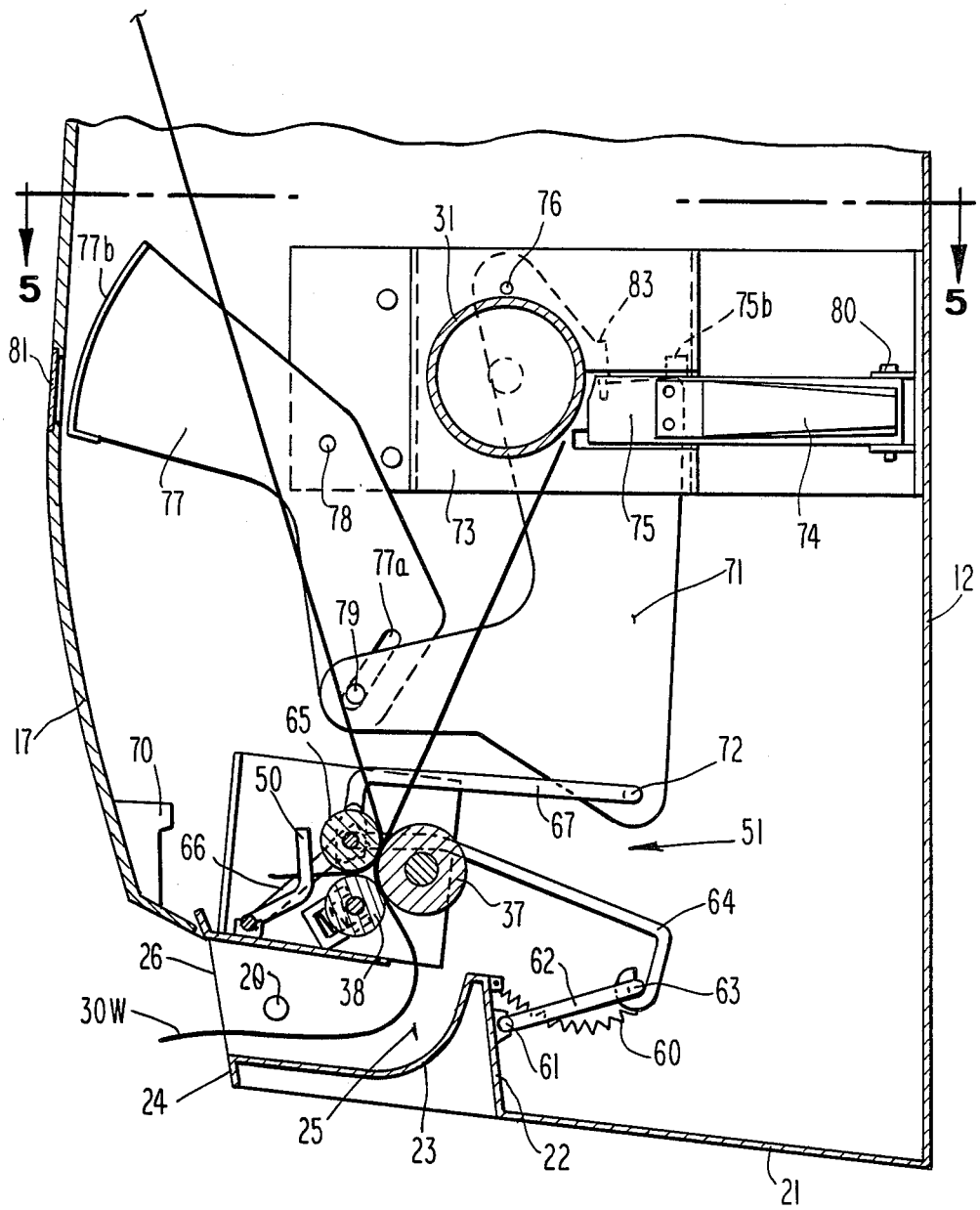
FIG. 3 is a partial sectional side elevation view showing the transfer means in the TRANSFER position after the first roll is nearly exhausted.
Figure 5:
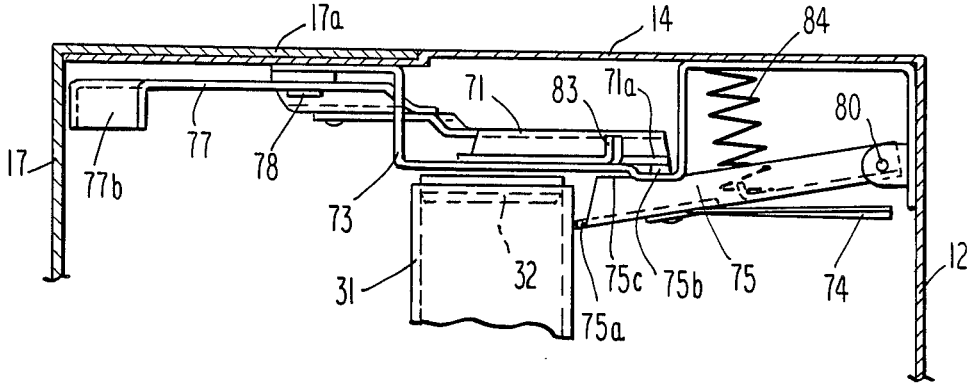
FIG. 5 is a section taken along the line 5—5 of FIG. 3.

As best illustrated in FIGS. 2 and 5, there is mounted in the left hand side of the cabinet a sensing arm 75 pivotally mounted at point 80 at the rear of the dispenser cabinet 10. Biasing means such as a spring 84, which has one end connected to the transfer housing bracket 73 and the other end connected to sensing arm 75, applies a force to the sensing arm 75 tending to cause sensing arm 75 to pivot about point 80 toward the center of the cabinet. A drag spring 74, mounted on the sensing arm 75, applies controlled friction to the edge of the roll 30 in order to prevent over spinning of the roll 30 as it is dispensed. When the roll 30 mounted on hubs 32, 33 has a sufficient diameter to resist movement of the biased sensing arm 75, a stop surface 75*a* on the sensing arm 75 intercepts a flange 83 on the actuator arm 71 which locates the transfer means 51 at a READY position as illustrated in FIG. 1. When the diameter of roll 30 has been reduced so that it can no longer resist the motion of biased sensing arm 75, the biased sensing arm 75 moves to the position shown in FIG. 5, and in so doing, stop 75*a* is removed from the path of flange 83 on actuator arm 71 thereby allowing the biased transfer means 51 to move to a TRANSFER position as illustrated in FIG. 3. In the TRANSFER position, the transfer roller 65 has placed the leading edge 28W of second roll 28 into a nip formed between transfer roller 65 and feed roller 37. As shown in FIG. 3, there may still be a small amount of web material 30W remaining on the first roll 30 at the instant of transfer. Immediately after the transfer, as feed rollers 37, 38 are driven to dispense paper from the cabinet, the web 28W will be fed through the nip 35 formed by feed rollers 37, 38 and until the first roll 30 is exhausted, sheets from both rolls 28 and 30 will be dispensed from cabinet 10.

As shown in FIG. 3, when the transfer means 51 has introduced web 28W into the nip of feed rollers 37, 38, flagg 77 is moved to a position such that surface 77*b* is adjacent a sight hole 81 in the front face of door 17. When the transfer means 51 is in the READY position as illustrated in FIG. 1, the surface 77*b* of flag 77 is located above the sight hole 81 in the door 17 and is, therefore, not visible through the sight hole 81. Thus, flag 77 provides an indication to the person servicing the dispenser cabinet 10 that the first roll 30 is exhausted and that the dispenser cabinet 10 is dispensing from the second roll 28.

As shown in FIG. 5, after transfer has occurred, surfaces 75*b* and 75*c* of sensing arm 75 are located adjacent to sensing arm stop surface 71*a* on actuator arm 71 so that sensing arm 75 cannot be pivoted back to the READY position until transfer means 51 including actuator arm 71 has been moved to a RELOAD position. This prevents the person servicing the dispenser cabinet 10 from trying to load a new roll 30 onto hubs 32 and 33 unless the transfer means 51 has been placed in the RELOAD position illustrated in FIG. 4. Referring now to FIGS. 4 and 4*a*, since bias spring 60 normally tends to move the transfer means 51 toward the rear of the cabinet 10, it is necessary to stabilize the transfer means 51 in the RELOAD position. This stabilizing means is provided by a detent 69 having a projection 69*a* located adjacent the left sidewall 14 of the dispenser 10. When the transfer means 51 is pulled forward to the RELOAD position, the middle transfer link 64 rides over and around projection 69*a* which is then able to overcome the force of bias spring 60 and stabilize the transfer means 51 in the RELOAD position. After the attendant has serviced the dispenser 10, the attendant closes the front door 17 of the dispenser 10, and when the front door 17 reaches the position shown in FIG. 4, a finger 70 mounted at the bottom of the door 17 contacts transfer roller 65 which applies sufficient force to the transfer means 51 so as to cause middle transfer link 64 to ride around the detent projection 69*a* thereby allowing bias spring 60 to move the transfer means 51 toward the rear of the cabinet 10. The transfer means 51 continues towards the rear of the cabinet until the flange 83 on actuator arm 71 is intercepted by the stop 75*a* on sensing arm 75 at which point the transfer means is in the READY position as illustrated in FIG. 1.

What follows is a brief description of the operation of the transfer means 51 starting with the transfer means 51 in the READY position as illustrated in FIG. 1 after the attendant has placed two new rolls 28, 30 in the dispenser cabinet 10 and has closed the front door 17 of the dispenser cabinet 10 so that it is ready for use. In this READY position, the biased sensing arm 75 is in the position illustrated in FIG. 2 with the stop surface 75*a* of sensing arm 75 intercepting flange 83 of actuator arm 71 thereby maintaining the transfer means 51 in the READY position. As paper is dispensed from the roll 30, at some point the diameter of roll 30 is reduced so that the edge of roll 30 is unable to provide resistance to the biased spring arm 75. When this occurs, spring 84 is able to move sensing arm 75 to the position indicated in FIG. 5 which removes the stop portion 75*a* of sensing arm 75 from the path of flange 83 to transfer arm 17 thereby allowing the spring 60 to move the transfer means 51 to the TRANSFER position illustrated in FIG. 3 which introduces the extended web 28W of second roll 28 into the nip formed between transfer roller 65 and feed roller 37. Further operation of the dispenser will result in dispensing both the web 28W from second roll 28 and the remaining web material 30W from first roll 30 through the cabinet until the web material from first roll 30 is exhausted. When the transfer means 51 is in the TRANSFER position, the front surface 77*b* of flag 77 is placed adjacent to window 81 in front door 17 to provide the attendant with an indication that the dispenser is now dispensing from the second roll 28. When the attendant comes to service the cabinet 10, door 17 is opened and since the first roll 30 is exhausted, the sensing arm 75 and the actuator arm 71 are positioned as shown in FIG. 5 with stop surface 71*a* of actuator arm 71 adjacent to the surface 75*b* of sensing arm 75 which prevents motion of sensing arm 75 toward sidewall 14 of the dispenser 10. This prevents the attendant from placing a new roll 30 onto hubs 32 and 33 until transfer means 51 is moved to the RELOAD position of FIG. 4. The attendant then refills the dispenser cabinet 10, for example, by placing two fresh rolls into the cabinet or by taking a partially expended second roll 28 and mounting that onto hubs 32 and 33 and then placing a fresh roll into the second roll 28 position and then extending the web 28W from the second roll 28 past the first roll 30 and then between the transfer roller 65 and feed rollers 37 and 38 and then impaling the end of the web 28W onto prong 50. The attendant then closes the door 17, and as door 17 closes, finger 70 mounted within the door 18 pushes transfer means 51 to the READY position.

FIGS. *7a* and *7b* show an alternate embodiment of the means for sensing the roll diameter and its associated stop means for the transfer means 51. In the embodiment of FIG. 7, a sensing arm 100 is pivotally mounted at pivot point 103. Biasing spring 84 biases the sensing arm 100 for motion towards the center of the cabinet 10. A leaf spring 10 is attached to sensing arm 100 by means of pin 102. Projection 104 which is either a part of or attached to leaf spring 101 extends either under sensing arm 100 or through a slot in sensing arm 100 to present a surface which stops a portion 105 of transfer means 51. Thus, the position of sensing arm 100 and the stop projection 104 and the portion 105 of transfer means 51 as represented in FIG. *7a* illustrate the position of these elements when the transfer means 51 is in the READY position. When roll 30 is exhausted so that the edge of roll 30 is no longer able to resist the biased motion of sensing arm 100, bias spring 84 will move sensing arm 100 toward the center of the cabinet 10 and stop projection 104 will be removed from the path of the portion 105 of transfer means 51 thereby allowing the transfer means 51 to move towards the rear of the cabinet 10, at which point the portion 105 of transfer means 51 will move to a position as shown in FIG. *7b*. In this embodiment, the transfer means 51 does not provide any limitation on the movement of sensing arm 100 which means that the attendant can load a fresh roll 30 onto hubs 32 and 33 even though the transfer means 51 is still in the TRANSFER position. Thus, FIG. *7b* shows transfer means 51 in the TRANSFER position with a fresh first roll 30 loaded in the cabinet 10. In the embodiment of FIG. 7, even though the attendant has loaded a fresh roll into the first position without first returning the transfer means 51 to the RELOAD position, the attendant can thereafter return transfer means 51 to the RELOAD position by pulling the transfer means 51 forward which causes the portion 105 of transfer means 51 to move forward in the direction as indicated by arrow 106 of FIG. *7b* until the front surface of portion 105 contacts the curved rear surface of projection 104 which moves leaf spring 101 in the direction indicated by arrow 107 so as to allow the transfer means 51 to be placed in the READY position of FIG. *7a*.

Figure 6:
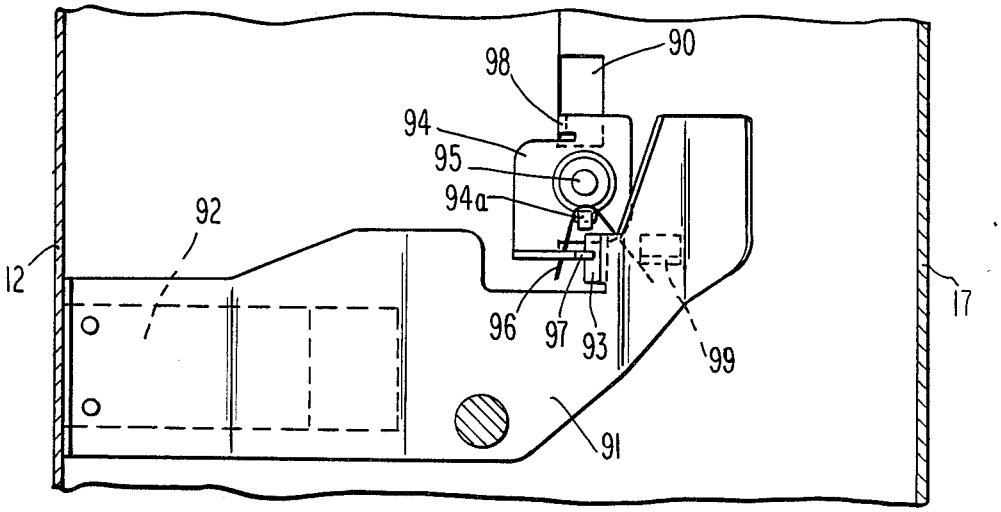
FIG. 6 is a partial sectional view taken along the line 6—6 of FIG. 2 showing the means for stabilizing the roll support arm.
Figure 6A:
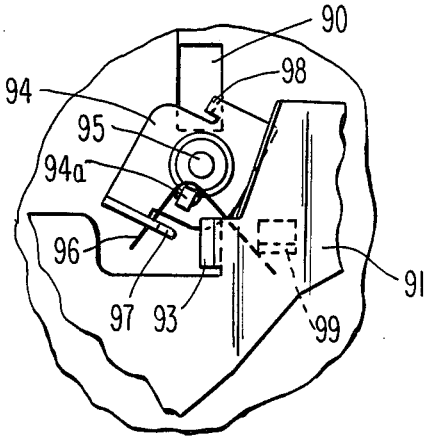
FIG. 6*a* is a partial side elevation of the means for stabilizing the roll support arm showing the position of the stabilizing means when the cabinet door is open.

Referring now to FIG. 2, the primary roll 30 is supported by a free wheeling hub 32 mounted on the transfer housing bracket 73 and a free wheeling hub 33 that is mounted on support arm 91. The support arm 91 is mounted to the rear wall 12 of the dispenser 10 and, in one preferred embodiment, is pivoted or hinged at point 89. A transfer spring 92 secured to arm 91 allows arm 91 to be spread in the axial direction of the roll 30 when inserting a new roll 30, but provides pressure on arm 91 tending to return arm 91 to its normal roll holding position. A stabilizer 94 is pivotally mounted, at pivot point 95, to the right sidewall 15 of the dispenser cabinet 10. As best shown in FIGS. 6 and 6*a*, mounted with the stabilizer 94 is a torsion spring 96, one end of which works against a retaining tab 99 in the sidewall 15 of the dispenser cabinet 10 while the other end acts against an edge of the stabilizer 94. The stabilizer 94 includes a tab 98 that extends through a hole 90 in the sidewall 15 of the dispenser 10 and teeth 97 which, as best shown in FIG. 2, are capable of intercepting a catch 93 on the arm 91. The stabilizer 94 has an inactive, or non-stabilizing position, and an active or stabilizing position. The non-stabilizing position is shown in FIG. 6*a* wherein the torsion spring 96 causes the stabilizer to pivot clockwise so that teeth 97 do not engage the catch 93 on arm 91. When the cover 17 of the dispenser 10 is closed, an edge of the cover engages tab 98 on the stabilizer 94 and rotates the stabilizer to the position illustrated in FIG. 6 which causes teeth 97 to engage catch 93 on arm 91 thereby limiting any lateral motion of arm 91 that may be caused, for example, by someone banging the side of the dispenser cabinet 10. Although it may be possible to use a single tooth or edge on stabilizer 94 to limit the lateral motion of arm 91, in the preferred embodiment, stabilizer 94 is provided with a plurality of teeth 97 to provide for the possibility that the location of catch 93 might be at a slightly different place depending upon the length of the roll 30 supported on hubs 32 and 33.

While the present invention has been described with reference to a specific embodiment thereof, it will be obvious to those skilled in the art that various changes and modifications may be made without departing from the invention in its broader aspects.

What is claimed as new and desired to be secured by Letters Patent of the United States is:

1. An improved rolled web dispenser cabinet, comprising a pair of feed rollers forming a feed roll nip, means for driving one of the feed rollers to dispense web from the cabinet, means in the cabinet for supporting a first roll of web material with its web extended between the feed roll nip, and means for supporting a second roll of web material with its web extended adjacent to the feed roll nip, the improvement comprising:

(a) means, contacting the edge of the first roll, having a first position for sensing the diameter of the first roll;

(b) means, connected to the sensing means, for biasing the sensing means against the edge of the first roll;

(c) biased transfer means for introducing the extended web of the second roll into the feed roll nip; and (d) stop means, connected to the sensing means, the stop means being located to resist motion of the transfer means at a ready position when the edge of the first roll resists movement of the sensing means, but when the edge of the first roll no longer resists movement of the sensing means, the sensing means and connected stop means moves to a second position which allows the biased transfer means to move to a transfer position where the extended web of the second roll is introduced into the feed roll nip.

2. The dispenser cabinet of claim 1 further comprising means for indicating that the web of the second roll has been introduced into the feed roll nip, the indicating means being responsive to the position of the sensing means and having a first position when the edge of the first roll resists motion of the sensing means and a second position when the edge of the first roll no longer resists motion of the sensing means.

3. The dispenser cabinet of claim 2 wherein the indicating means is connected to the transfer means.

4. The dispenser cabinet of claim 1 wherein the biased transfer means comprises;

(a) a transfer mechanism, mounted in the cabinet, capable of movement to introduce the extended web of the second roll into the feed roll nip;

(b) a spring mounted in the dispenser and connected to the transfer mechanism so as to bias the transfer mechanism to introduce the extended web of the second roll into the feed roll nip.

5. The dispenser of claim 1 wherein after the biased transfer means introduces the extended web of the second roll into the feed roll nip, a portion of the transfer means prevents the sensing means from returning to the first sensing position.

6. The dispenser cabinet of claim 1 having a first roll mounted therein wherein the stop means can nove with respect to the sensing means, the dispenser further comprising means for biasing the stop means against motion with respect to the sensing means so that as the transfer means is moved from the transfer position to the ready position, a surface of the transfer means cooperates with a surface of the stop means to move the stop means out of the path of the transfer means, said stop biasing means returning the stop means to said location for resisting motion of the transfer means when the transfer means reaches the ready position.

7. The dispenser cabinet of claim 1 having a door and wherein the means for supporting one roll in the cabinet has at least one arm spreadable in the axial direction of the roll to facilitate mounting a new roll in the cabinet, the dispenser cabinet further comprising means, mounted in the cabinet, responsive to the position of the door for stabilizing the spreadable arm, the arm stabilizing means having a first position that allows spreading of the one arm when the door is open and a second position that limits spreading of the one arm when the door is closed.

8. The dispenser cabinet of claim 7 wherein the stabilizing means comprises:

(a) a stabilizer, mounted in the cabinet, having a first position that allows spreading of the one arm when the door is open and a second position that limits spreading of the one arm when the door is closed;

(b) biasing means mounted in the cabinet for urging the stabilizer toward the first position; and (c) a tab, connected to the stabilizer, contacted by the door so that the stabilizer is moved to the second position when the door is closed and is allowed to return to the first position when the door is open.

9. An improved cabinet for dispensing a web wound on a core, the cabinet having a door and means for supporting the roll in the cabinet, said supporting means having at least one arm spreadable in the axial direction of the roll to facilitate mounting a new roll in the cabinet wherein the improvement comrpises means, mounted in the cabinet, responsive to the position of the door for stabilizing the spreadable arm, the arm stabilizing means having a first position that allows spreading of the one arm when the door is open and a second position that limits spreading of the one arm when the door is closed.

10. The dispensing cabinet of claim 9 wherein the stabilizing means comprises:

(a) a stabilizer, mounted in the cabinet, having a first position that allows spreading of the one arm when the door is open and a second position that limits spreading of the one arm when the door is closed;

(b) biasing means mounted in the cabinet for urging the stabilizer toward the first position; and (c) a tab connected to the stabilizer contacted by the door so that the stabilizer is moved to the second position when the door is closed and is allowed to return to the first position when the door is open.

* * * * *